US007971290B2

(12) United States Patent
Woodhams

(10) Patent No.: US 7,971,290 B2
(45) Date of Patent: Jul. 5, 2011

(54) BUNK BED WITH REVERSIBLE STAIRCASE AND DRAWER UNIT

(75) Inventor: Mark L. Woodhams, Peru, IN (US)

(73) Assignee: Woodcrest Manufacturing, Inc., Peru, IN (US)

( * ) Notice: Subject to any disclaimer, the term of this patent is extended or adjusted under 35 U.S.C. 154(b) by 177 days.

(21) Appl. No.: 12/489,794

(22) Filed: Jun. 23, 2009

(65) Prior Publication Data

US 2010/0319120 A1 Dec. 23, 2010

(51) Int. Cl.
*A47C 19/20* (2006.01)
*A47C 19/22* (2006.01)
*A47B 83/00* (2006.01)

(52) U.S. Cl. ..... 5/9.1; 5/2.1; 5/308

(58) Field of Classification Search ..... 5/2.1, 9.1, 5/308; 312/235.1, 237

See application file for complete search history.

(56) References Cited

U.S. PATENT DOCUMENTS

| | | | | |
|---|---|---|---|---|
| 4,139,077 | A * | 2/1979 | Pena, Jr. | 182/35 |
| D441,559 | S * | 5/2001 | Walsh | D6/384 |
| 6,568,001 | B2 * | 5/2003 | Walsh | 5/2.1 |
| 6,721,969 | B1 | 4/2004 | Lupo et al. | |
| 7,832,031 | B1 * | 11/2010 | Lupo | 5/9.1 |
| 2003/0070224 | A1 * | 4/2003 | Walsh | 5/2.1 |
| 2010/0319120 | A1 * | 12/2010 | Woodhams | 5/2.1 |

OTHER PUBLICATIONS

"Twin-Twin Stairway Bed" by Woodcrest Maufacturing—Heartland Collection—Model STH-500 http://www.woodcrestmfg.com/products/collection~heartland.htm.

* cited by examiner

*Primary Examiner* — Robert G Santos
(74) *Attorney, Agent, or Firm* — Woodard Emhardt Moriarty McNett & Henry LLP

(57) ABSTRACT

A bunk bed having a staircase and chest unit that can be mounted to either end of the bunk bed frame. The staircase opens to the front side of the bunk bed whereas drawers pull outwardly in a direction from the end of the bunk bed. The drawers may be mounted to either end of the bed frame with the drawers being reversible.

15 Claims, 6 Drawing Sheets

26

BUNK BED WITH REVERSIBLE STAIRCASE AND DRAWER UNIT

BACKGROUND OF THE INVENTION

1. Field of the Invention

The present invention relates generally to the field of bunk beds.

2. Description of the Prior Art

Bunk bed units have an upper bunk and lower bunk with a ladder provided for access to the upper bunk. Further, many bunk bed units have storage drawers slidably mounted to the unit to facilitate storing of clothing and bedding. For example, see U.S. Pat. No. 6,721,969 issued to Lupo et al. which includes both an upper and lower bunk, drawers and a ladder.

It is known to manufacture a bunk bed having a staircase mounted to one end of the bunk bed that opens towards the front of the bed. The same bunk bed includes a plurality of drawers which pull outwardly from the end of the bunk bed. Such a bunk bed is disclosed as model STH-500 entitled "Twin-Twin Stairway Bed" by Woodcrest Manufacturing—Heartland Collection. The bunk bed has a bunk bed frame that is permanently attached to the staircase and chest drawer combination. That is, the staircase and drawers may not be removed from one end of the bed frame and moved to the opposite end particularly since the drawers are not reversible in that the drawers are not slidably mounted to either side of the staircase frame.

SUMMARY OF THE INVENTION

One embodiment of the present invention is a bunk bed frame having an upper bunk and a lower bunk with a head end and a foot end with a front side extending therebetween. A pair of vertical posts are mounted to the bunk bed frame and provide the sole support for the head end. A universal combination staircase and chest unit are mounted to the bunk bed frame and provide the sole support for the foot end. The staircase and chest unit is interchangeable with the vertical posts to provide the sole support for the head end while the vertical posts provide the sole support for the foot end. The staircase and chest unit includes a front step entrance with the step entrance forming a plurality of steps opening on the front side of the bunk bed frame allowing a person to climb up to the upper bunk from the front side regardless of whether the staircase and chest unit is mounted to the head end or the foot end. A plurality of drawers are slidably mounted to the staircase and chest unit that are pullable outwardly through one side when the staircase and chest unit is mounted to the foot end and through another side when the staircase and chest unit is mounted to the head end.

DESCRIPTION OF THE PREFERRED EMBODIMENT

Figure 1:
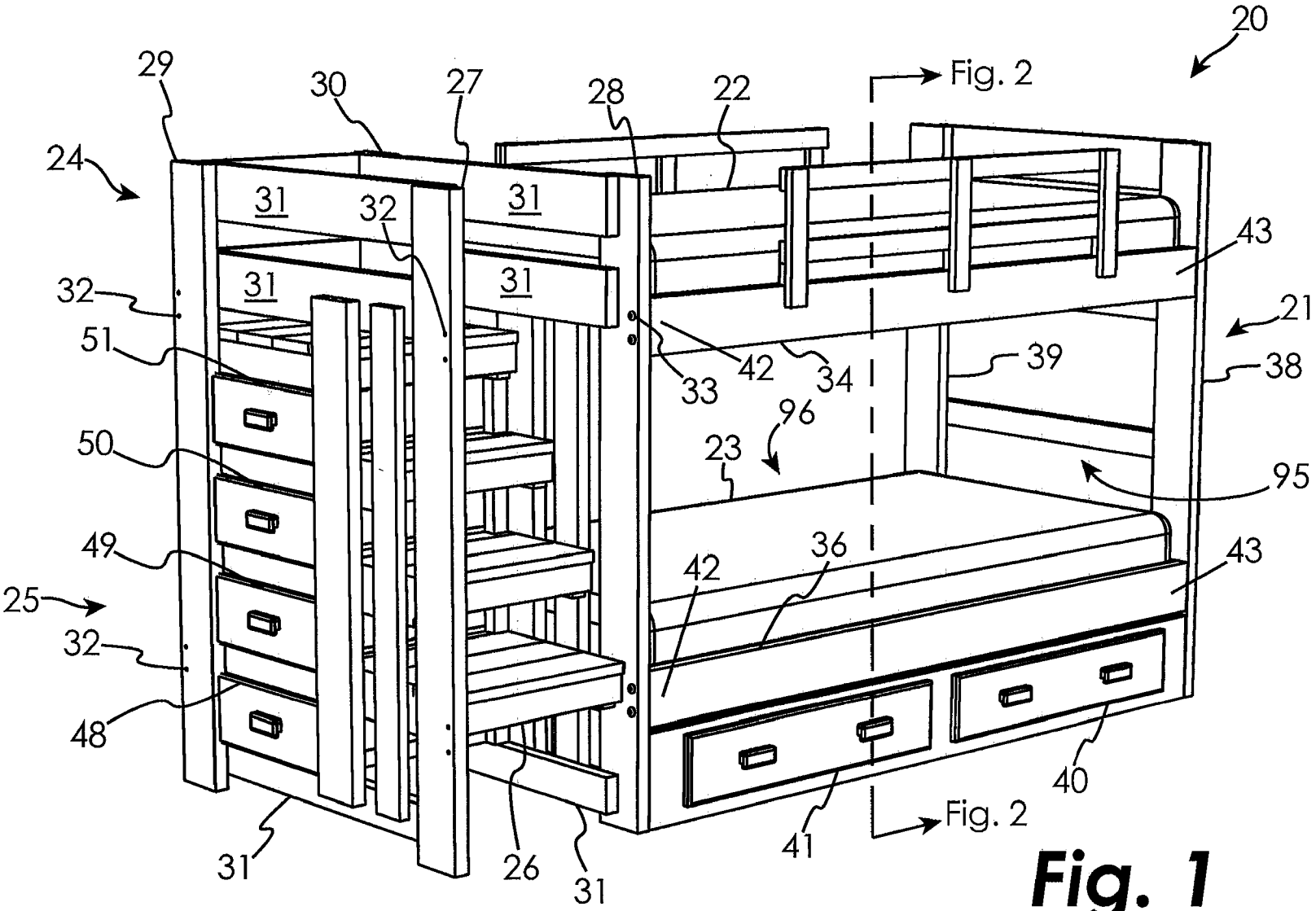
FIG. 1 is a perspective view of the preferred embodiment of the bunk bed incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a bunk bed 20 with a universal staircase and chest unit 24 removably mounted to an end of the bunk bed. Bunk bed frame 21 includes an upper bunk 22 and a lower bunk 23 with supporting structure to support the mattresses for the upper and lower bunk. The universal staircase and chest unit 24 is configured along with the bunk bed frame to be mounted to either end of the bunk bed frame. In other words, the staircase and chest unit can be mounted to one end and then removed and mounted to the opposite end of the bed frame with the drawers 25 still being pullable outwardly and with the staircase still opening outwardly on the front of the bunk bed.

The staircase and chest unit 24 has a pair of front posts 27 and 28 and a pair of rear posts 29 and 30 connected to a plurality of cross members 31 extending from the rear posts to the front posts. Cross members 31 are located both at the top and the bottom of the staircase and chest unit. The cross members 31 extend from the rear of the bunk bed towards the front of the bunk bed and connect together rear post 29 and front post 27 and also connect together rear post 30 and front post 28.

Figure 2:
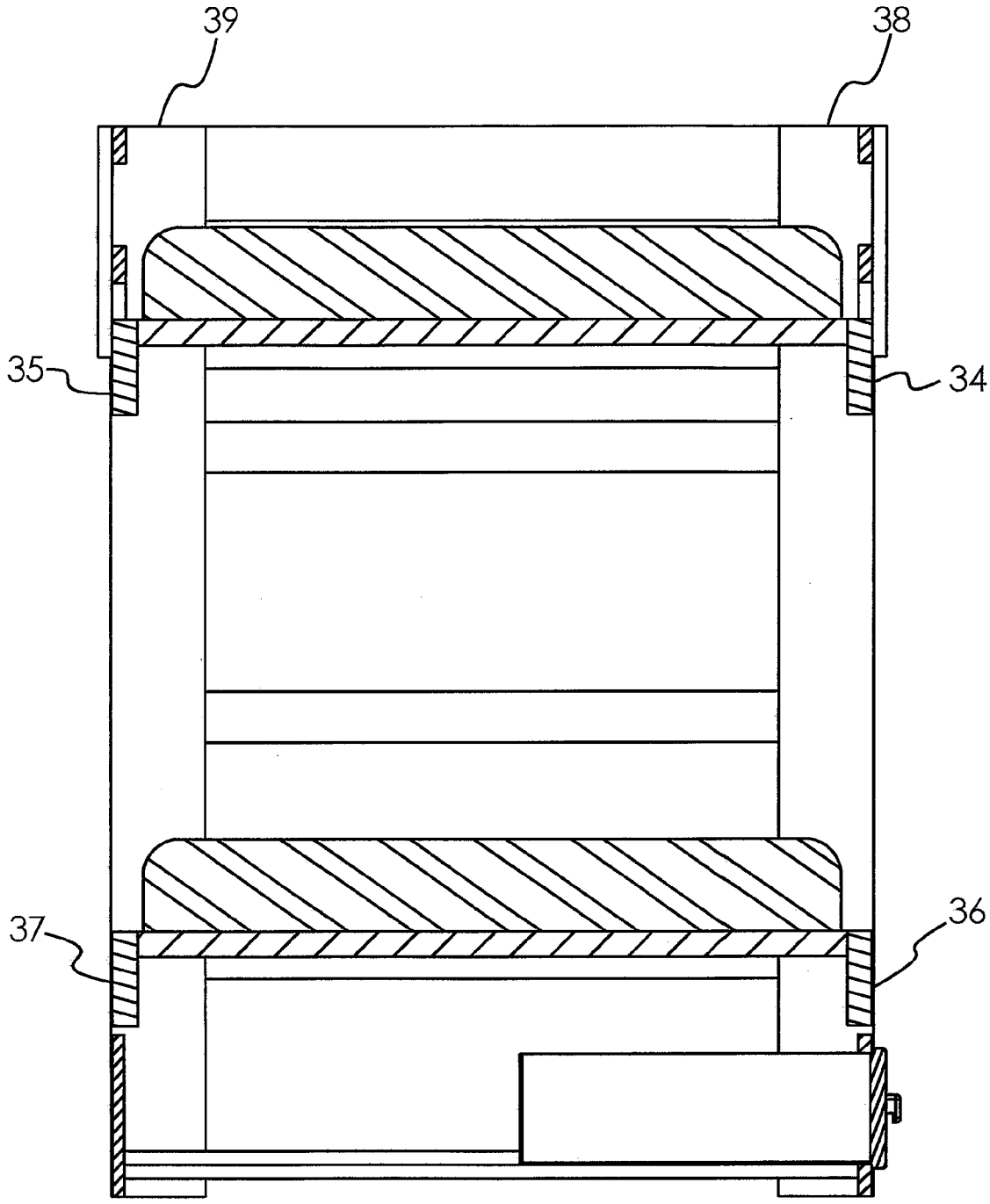
FIG. 2 is an enlarged cross-sectional view taken along the line 2-2 of FIG. 1 and viewed in the direction of the arrows.

Bunk bed frame 21 has two vertically extending members or posts 38 and 39 mounted to the ends of horizontally extending members 34, 35, 36 and 37 (FIG. 2) and are located opposite of the ends of the horizontally extending members connected to the staircase and chest unit. In other words, the bunk bed frame does not have a second pair of vertically extending members mounted to the ends of horizontally extending members 34-37 opposite of vertically extending members 38 and 39. Instead, the post of the staircase and chest unit are affixed to the horizontally extending members 34-37 of the bunk bed frame supporting one end of the bunk bed frame, whereas vertical members 38 and 39 support the opposite end of the bunk bed frame.

In the case of the staircase and chest unit being located to the left of the bunk bed frame as viewed in FIG. 1, posts 28 and 30 are fixedly secured to the ends of horizontally extending members 34-37 of the bunk bed frame. A plurality of holes are provided on posts 28 and 30 to allow conventional fastening devices 33 to extend therethrough securing posts 28 and 30 to the horizontally extending members 34-37.

Figure 3:
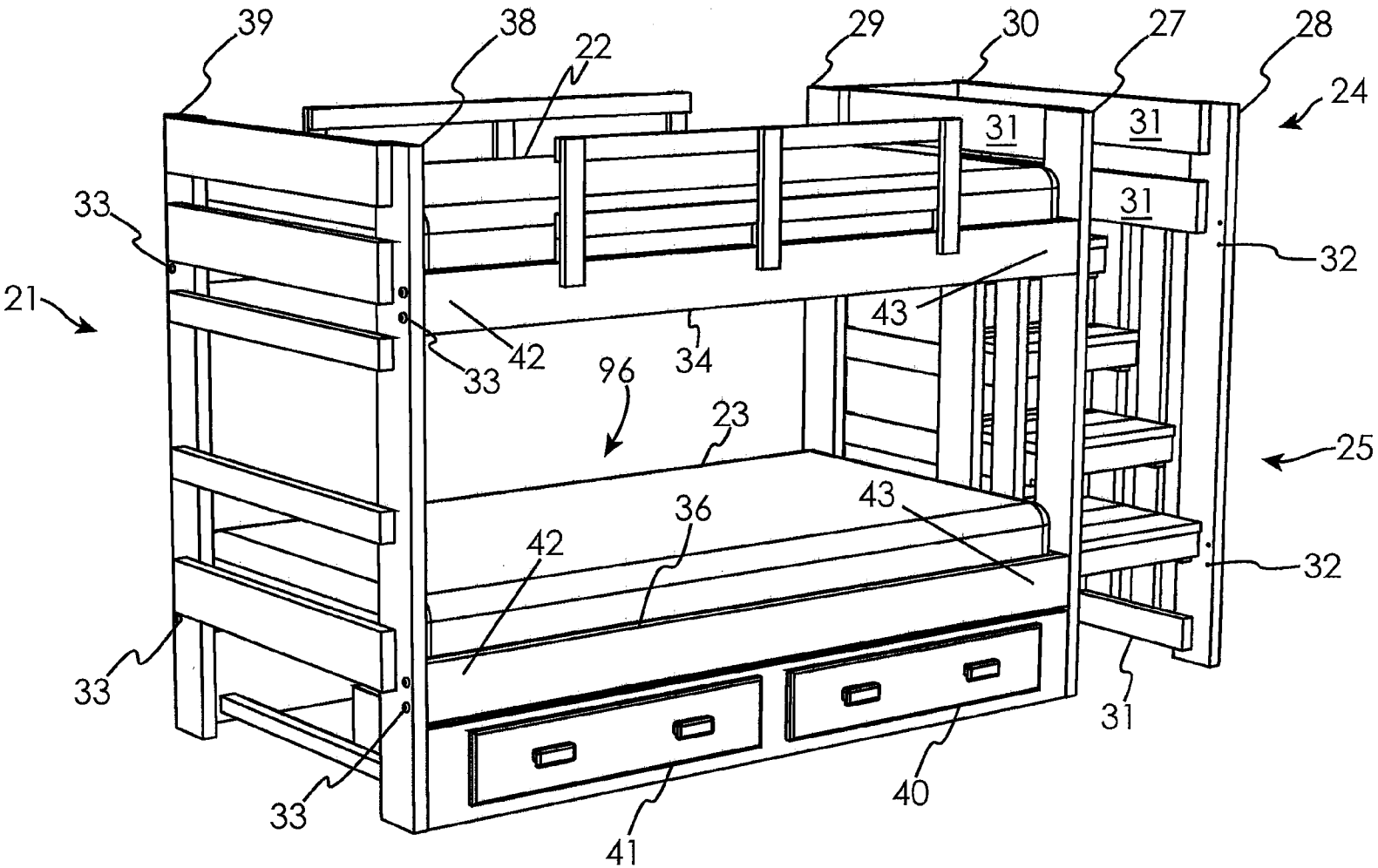
FIG. 3 is the same view as FIG. 1 only illustrating the staircase and chest unit mounted to the opposite end of the bed frame as compared to FIG. 1.

Stairs 26 (FIG. 1) open outwardly as depicted in FIG. 1 at the front of the bunk bed which also has a pair of storage drawers 40 and 41 slidably mounted to the front of the bunk bed frame. In the event the staircase and chest unit is to be mounted to the right end of the bunk bed as depicted in FIG. 3, the drawers 25 are removed, fasteners 33 are removed and the staircase and chest unit is moved to the right end of the bunk bed frame. Vertically extending members 39 and 38 are then removed from the bunk bed frame and mounted to the opposite end of the bed frame being fixedly secured to ends 42 (FIG. 1) of the horizontally extending members 34-37. Posts 27 and 29 have a plurality of holes 32 extending therethrough that align with ends 43 of the horizontally extending members 34-37 with the fasteners 33 then being extended therethrough to fixedly secure post 27 and 29 directly to ends 43 of the horizontally extending members 34-37. Drawers 25 are then slidably mounted into the drawer passages provided in a chest. When initially assembling the bunk bed with the staircase and chest unit, the staircase and chest unit is mounted to the desired end of the bunk bed. Due to the universality of the staircase and chest unit, i.e., the unit can be mounted to either end of the bunk bed, it is only necessary to produce and stock one unit. Further, the buyer will be able to change the location of the staircase and chest unit relative to the bunk bed.

Figure 4:
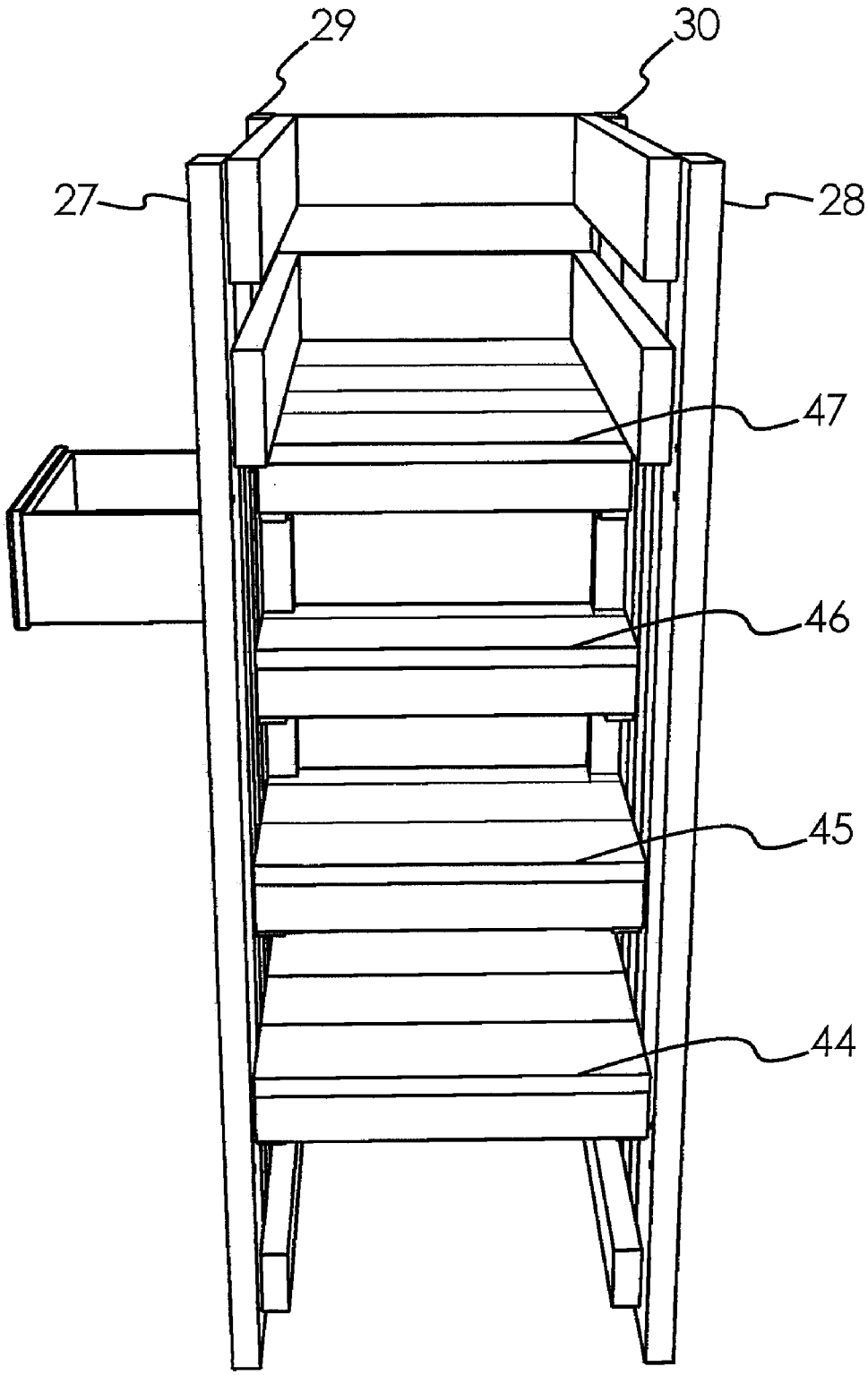
FIG. 4 is a front view of the staircase and chest unit removed from the bed frame.

Referring to FIG. 4, there is shown a front view of the staircase and chest unit removed from the bunk bed frame. Three steps 44, 45 and 46 are provided with a platform 47 located atop the steps allowing a person to climb steps 44-46 and then onto platform 47 positioning the person to climb into the upper bunk. The staircase and chest unit may be produced from wood or other suitable materials.

In the same embodiment, four drawers 48, 49, 50 and 51 (FIG. 1) are slidably mounted to the staircase and chest unit and are arranged in a vertical row rearwardly of steps 44-46 which are located to the front side of the frame. Four passages 52, 53, 54 and 55 (FIG. 7) are provided in the staircase and chest unit to slidably receive respectively drawers 48, 49, 50 and 51.

Figure 6:
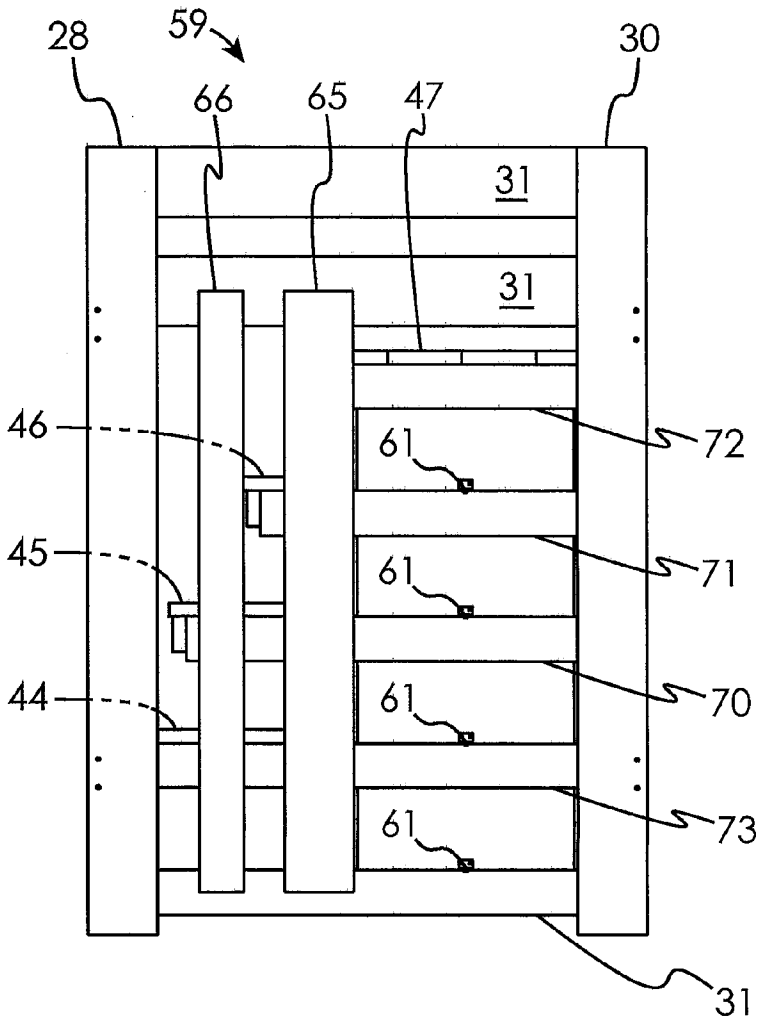
FIG. 6 is a right side view of the staircase and chest unit of FIG. 4.
Figure 5:
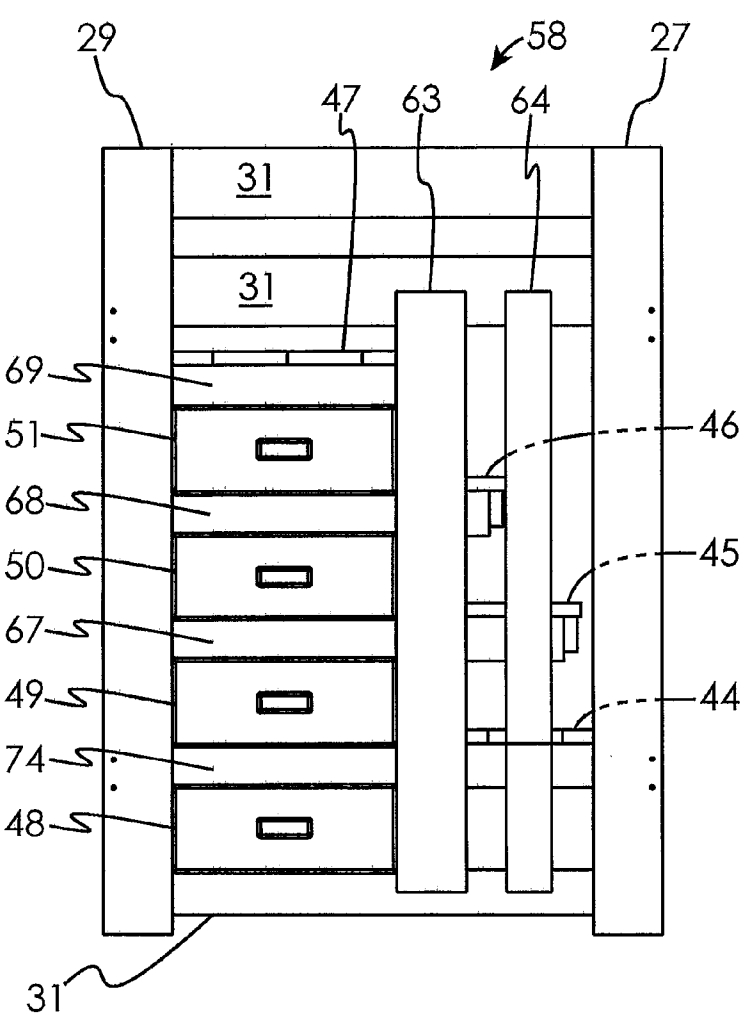
FIG. 5 is a left view of the staircase and chest unit of FIG. 4.
Figure 7:
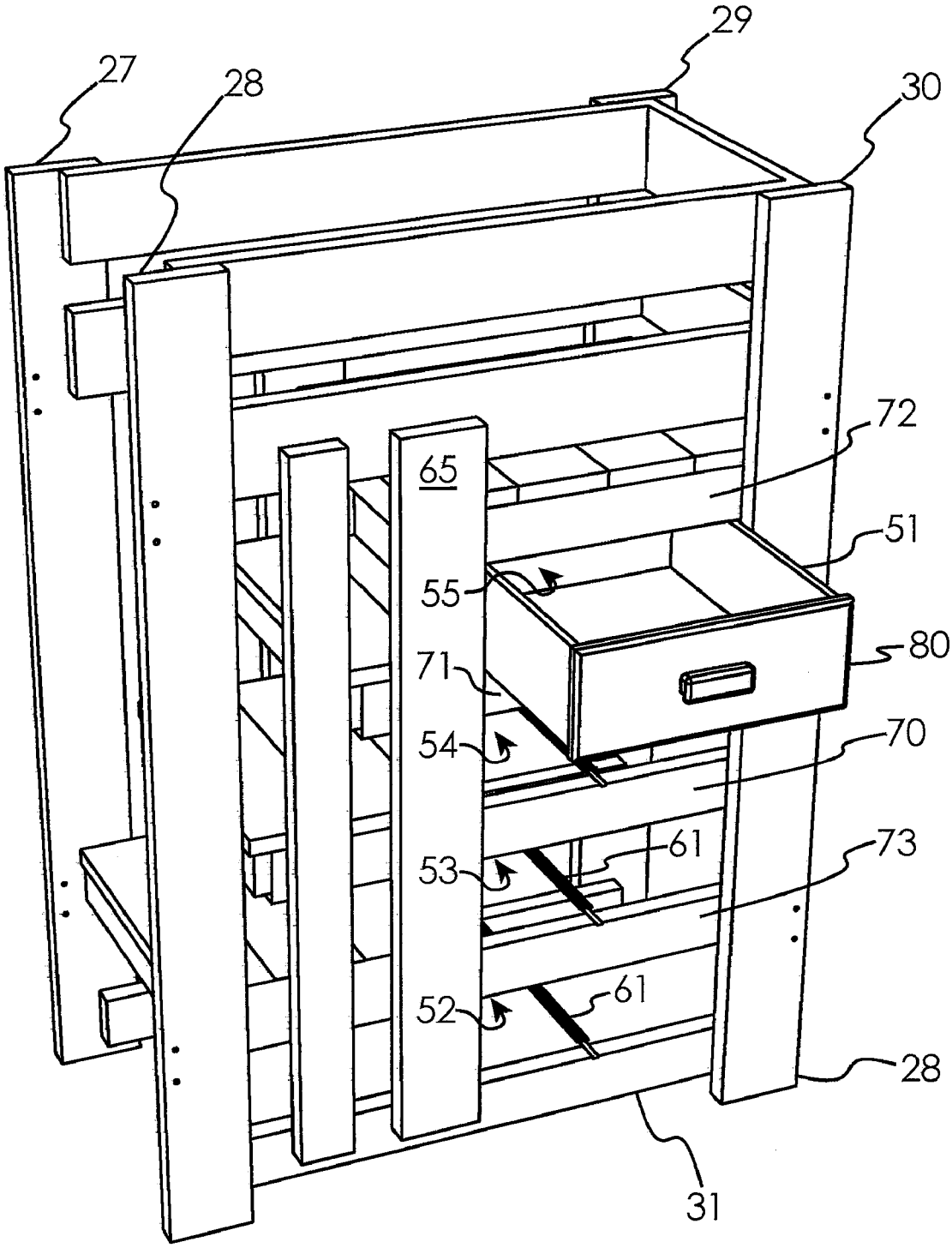
FIG. 7 is a fragmentary perspective view of the staircase and chest of FIG. 6 with several drawers removed from the chest illustrating the interior passages.

The left side 58 (FIG. 5) of the staircase and chest unit minus the drawers as viewed in FIG. 1, is a mirror image of the right side 59 (FIG. 6). Thus, cross members 31 are connected to and extend forwardly from the rear post 29 to the front post 27 (FIG. 7). Additional cross members 31 are connected to and extend forward from rear post 30 to front post 28. Conventional metal center drawer rails or guides 61 are mounted atop the cross members to provide a supporting guide for the drawers slidably mounted thereto. Guides 61 (FIG. 7) extend from one side 58 (FIG. 5) to the opposite side 59 (FIG. 6) of the staircase and chest unit. A pair of vertically extending members 63 and 64 are mounted between posts 27 and 29 on side 58 and are attached to cross members 31. Likewise, a second set of vertically extending members 65 and 66 are attached to the cross members 31 on side 59 and are located between posts 28 and 30.

Horizontally extending members 74, 67, and 68 (FIG. 5) are attached to post 29 and vertical member 63 whereas horizontally extending members 73, 70, and 71 (FIG. 6) are attached to post 30 and vertically extending member 65. Steps 44-46 (FIG. 4) are comprised of a plurality of horizontally extending members fixedly mounted atop the horizontally extending members 67, 68, 70, 71, 73, and 74. Platform 47 likewise includes a plurality of horizontally extending members mounted atop the horizontally extending members 69 and 72 attached respectively to post 29 and member 63 and to post 30 and member 65

Four separate drawer passages 52, 53, 54, 55 (FIG. 7) are formed between the rear post 28 and 29 and members 63 and 65 and horizontally members 31, 67-74. Center guides 61 are mounted atop members 31, 67, 68, 70, 71, 73 and 74 and extend from one side 58 of the staircase chest unit to the other side 59 providing rails upon which the drawers slide. The drawers include a center groove slidably receiving guides 61. Drawers 48-51 (FIG. 1) may be removed from the left side of the chest and slidingly received into the same passages, namely, respectively passages 52-55 (FIG. 7) from either side 58 (FIG. 5) or 59 (FIG. 6). One such drawer 51 is shown positioned in passage 55 in FIG. 7 it being understood that the remaining three drawers 48-50 may be slidingly mounted in the remaining three passages. The length of each drawer passage extends from side 58 to side 59 whereas the length of each drawer slidingly received by the passage is less than the length of each passage. When the staircase and chest unit is mounted to the left of the bed frame as shown in FIG. 1, the drawers are slidingly received through side 58 whereas with the staircase and chest unit mounted to the right side of the bed frame as shown in FIG. 3, the drawers are extended through side 59. Each drawer has an outer face plate that abuts against members 31, 67-74 depending upon which particular passage the drawer is slidably mounted. For example, drawer 51, has a face plate 80 (FIG. 7) having an inwardly projecting surface forming a stop surface in contact with the outwardly facing surface of members 71 and 72 limiting inwardly movement of the drawer when the staircase and chest unit is mounted to the right side of the bed frame (FIG. 3) whereas the inwardly facing surface of face plate 80 contacts members 69 and 68 when the drawer is mounted to side 58 (FIG. 5) of the staircase and chest unit when mounted to the left side of the bed frame (FIG. 1).

Many advantages arise from use of the universal staircase and chest unit disclosed in the drawings. The bunk bed has a front side 95 and a rear side 96. In many cases, the rear side 96 will be positioned adjacent a wall allowing entrance to the two bunks from only the front side. Thus, it is important that the staircase always open outwardly on the front side regardless of whether the staircase and chest unit is mounted to the left side as shown in FIG. 1 or the right side of the bunk bed as shown in FIG. 3. Thus, instead of stocking two different combination staircase and chest units, the universal staircase and chest unit disclosed herein allows the staircase and chest unit to be mounted to either the left side or right side of the bed frame while maintaining the steps opening to the front side of the bed. This is particularly advantageous from an inventory standpoint during the manufacturing process and also during the assembly process by the consumer to select the end of the bed frame to which the staircase and chest unit are to be mounted. Further, the drawers may be mounted to either side of the chest depending upon which end of the bed frame the staircase and chest unit are to be mounted. Likewise, in the event the bunk bed is assembled in position, it is possible to move the staircase and chest unit to the opposite end of the bed in case the bunk bed is to be mounted in a different room position. Thus, the vertically extending members 38 and 39 of the bed frame are removed and positioned at the opposite end of the bed frame while the chest and staircase unit are removed from the bed frame through the removal of the fasteners 33 extending through apertures 32. The drawers are removed from the chest and reinserted in the passages on the opposite side of the chest. Thus, the bunk bed disclosed herein provides significant advantages in the manufacturing and inventory of the components as well as facilitates the ease of assembly, disassembly and reassembly.

Posts 27-30 and vertically extending members 38 and 39 have sufficient length when the staircase and chest frame is attached to the bunk bed frame to contact the floor or other supporting surface upon which the bunk bed rests. Members 38 and 39 provide the sole support for one end of the bed frame whereas posts 27-30 provide the sole support for the opposite end of the bed frame depending upon which end the bed frame the staircase and chest are mounted.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A bunk bed with a universal staircase and chest unit removably mountable to either end of the bunk bed comprising:

a bunk bed frame including horizontally extending members and vertically extending members forming a lower bunk and an upper bunk, said frame having a first end and an opposite second end and further having a front side and an opposite rear side extending between said first end and said second end;

a plurality of drawers; and, a plurality of connectors;

a staircase frame mounted to said bunk bed frame, said staircase frame having an opening with steps and an opposite back end and further having a first side and a second side extending on opposite sides between said opening and back end, said steps opening on said front side of said bunk bed frame allowing a person to climb the steps from the front of said staircase frame to said upper bunk regardless of whether said staircase frame is mounted to said first end or said second end of said bunk bed frame; and wherein:

said connectors selectively mount said first side of said staircase frame to said first end of said bunk bed or said second side of said staircase frame to said second end of said bunk bed;

said staircase frame has a plurality of drawer passages each opening outwardly through said first side and said second side and slidably receiving said plurality of drawers forming a chest;

said first side of said staircase frame is adjacent said bunk bed frame when mounted to said first end of said bunk bed frame with said second side facing outwardly with said steps opening on said front side of said bunk bed frame and said drawers pullable outwardly through said second side of said staircase frame; and, said second side of said staircase frame is adjacent said bunk bed frame when mounted to said second end of said bunk bed frame and said first side facing outwardly with said steps opening on said front side of said bunk bed frame and said drawers pullable outwardly through said first side of said staircase frame.

2. The bunk bed of claim 1 wherein:

said first side and said second side of said staircase frame are mirror images of each other.

3. The bunk bed of claim 1 wherein:

said staircase frame includes a first pair of posts on said first side and a second pair of posts on said second side that are connectable to said bunk bed frame; and said connectors connecting said first pair of posts to said first end of said bunk bed frame when said first side is adjacent to said bunk bed frame and connecting said second pair of posts to said second end of said bunk bed frame when said second side is adjacent to said bunk bed frame.

4. The bunk bed of claim 3 wherein:

said bunk bed frame includes a storage compartment slidably mounted thereto beneath said lower bunk pullable outwardly from said front side of said bunk bed frame.

5. The bunk bed of claim 4 wherein:

said drawers each have an outer enlarged face forming a stop surface in contact with said second side of said staircase frame limiting inward movement of said drawers when said staircase frame is mounted to said first end of said bunk bed frame and in contact with said first side of said staircase frame limiting inward movement of said drawers when said staircase frame is mounted to said second end of said bunk bed frame.

6. The bunk bed of claim 5 wherein:

said first pair of posts, said second pair of posts, and said vertically extending members have lengths sufficient when said staircase frame is attached to said bunk bed frame to contact the floor upon which the bunk bed rests.

7. The bunk bed of claim 6 wherein:

said first pair of posts and said second pair of posts extend vertically and are attached to said horizontally extending members of said bunk bed frame by said connectors when said staircase frame is mounted respectively to said first end and said second end of said bunk bed frame.

8. The bunk bed of claim 7 wherein:

said staircase frame includes a platform atop said steps to allow a person to be positioned on when entering and exiting said upper bunk.

9. The bunk bed of claim 8 wherein:

said first side and said second side of said staircase frame are mirror images of each other;

said bunk bed frame includes a pair of spaced apart lower horizontally extending members for said lower bunk and a pair of spaced apart upper horizontally extending members for said upper bunk, said bunk bed frame further includes a single pair of vertically extending members connected to said pair of lower horizontally extending members and said pair of upper horizontally extending members to provide the sole support for same at an end of said bunk bed frame opposite of the end of said bunk bed frame connected to said staircase frame with said staircase frame connected to said pair of lower horizontally extending members and said pair of upper horizontally extending members to provide the sole support for same at an end of said bunk bed frame opposite of the end of said bunk bed frame connected to said pair of vertically extending members, said pair of vertically extending members are interchangeable with said staircase frame as said staircase frame is moved from one end to another end of said bunk bed frame.

10. A bunk bed comprising:

a bunk bed frame having an upper bunk and a lower bunk with a head end, a foot end and a front side extending therebetween;

a pair of vertical posts mounted to said bunk bed frame and providing the sole support for said head end;

a universal combination staircase and chest unit mounted to said bunk bed frame and providing the sole support for said foot end, said staircase and chest unit interchangeable with said vertical posts to provide the sole support for said head end while said vertical posts provide the sole support for said foot end, said staircase and chest unit includes a front step entrance with said step entrance forming a plurality of steps opening on said front side of said bunk bed frame allowing a person to climb up to said upper bunk from said front side regardless of whether said staircase and chest unit is mounted to said head end or said foot end, said combination staircase and chest unit further including a first side and a second side with said step entrance therebetween; and, a plurality of drawers slidably mounted to said staircase and chest unit that are pullable outwardly through said first side when said staircase and chest unit is mounted to said foot end and through said second side when said staircase and chest unit is mounted to said head end.

11. The bunk bed of claim 10 and further comprising:

a plurality of fasteners extending from said second side of said staircase and chest unit to said foot end of said bunk bed frame when said staircase and chest unit is mounted to said foot end, said fasteners extending from said first side of said staircase and chest unit to said head end of said bunk bed frame when said universal combination staircase and chest unit is mounted to said head end.

12. The bunk bed of claim 11 wherein:

said staircase and chest unit includes vertical members on both said first side and said second side with said fasteners extending from said vertical members on said second side to said foot end when mounted thereto and from said vertical members on said first side to said head end when mounted thereto.

13. The bunk bed of claim 12 wherein:

said first side and said second side of said staircase and chest unit are mirror images of each other.

14. The bunk bed of claim 13 wherein:

said pair of posts and said vertical members have lengths sufficient when said staircase and chest unit is attached to said bunk bed frame to contact the floor upon which the bunk bed rests.

15. The bunk bed of claim 14 wherein:

said drawers are aligned vertically in a row located apart from said steps which are located to the side of said row.

* * * * *